United States Patent [19]

Pardo

[11] Patent Number: 4,993,206

[45] Date of Patent: Feb. 19, 1991

[54] INTERLOCKING BUILDING UNITS AND WALLS CONSTRUCTED THEREBY

[75] Inventor: Jorge Pardo, Reston, Va.

[73] Assignee: National Concrete Masonry Association, Herndon, Va.

[21] Appl. No.: 380,016

[22] Filed: Jul. 14, 1989

Related U.S. Application Data

[63] Continuation-in-part of Ser. No. 305,829, Feb. 3, 1989, abandoned, which is a continuation-in-part of Ser. No. 228,152, Aug. 4, 1988, abandoned.

[51] Int. Cl.[5] ..... E02D 29/02

[52] U.S. Cl. ..... 52/589; 52/302; 52/609; 52/593; 405/284

[58] Field of Search ..... 52/593, 609, 98, 302, 52/303, 589; 405/16, 20, 286, 284, 273

[56] References Cited

U.S. PATENT DOCUMENTS

| | | | |
|---|---|---|---|
| 250,635 | 12/1881 | McLean | 405/284 |
| 468,838 | 2/1892 | Steiger | 52/593 |
| 1,258,839 | 3/1918 | Wheeler | 52/20 |
| 1,462,374 | 7/1923 | Metz | 52/245 |
| 1,688,305 | 10/1928 | Fitzgerald | 405/273 |
| 1,771,796 | 4/1930 | Leuzinger . | |
| 1,871,488 | 11/1932 | Alexander . | |
| 1,909,539 | 5/1933 | Huntoon . | |
| 4,335,549 | 6/1982 | Dean | 52/98 |
| 4,426,176 | 1/1984 | Terada | 405/286 |
| 4,490,075 | 1/1984 | Risi et al. | 405/273 |
| 4,524,551 | 6/1985 | Scheiwiller | 405/286 |
| 4,711,606 | 12/1987 | Leling et al. | 405/286 |
| 4,781,492 | 11/1988 | Shindo | 405/16 |
| 4,815,897 | 3/1989 | Risi | 405/284 |

FOREIGN PATENT DOCUMENTS

| | | | |
|---|---|---|---|
| 744126 | 10/1966 | Canada | 405/16 |
| 39372 | 11/1981 | European Pat. Off. | 405/286 |
| 1192074 | 10/1959 | France | 52/593 |
| 264291 | 11/1981 | Japan | 405/284 |
| 610041 | 3/1979 | Switzerland | 405/273 |

OTHER PUBLICATIONS

Keystone "Retaining Wall Systems".

Dynoblock "Mortarless Self-Interlocking Concrete Units".

Porcupine "One Good Point Supports Another".

*Primary Examiner*—John E. Murtagh

*Attorney, Agent, or Firm*—Lane, Aitken & McCann

[57] ABSTRACT

Interfitting modular construction units include alternating plateaus and recesses which interfit with one another to form walls without mortar. Drainage grooves are defined in the units, bevels are provided on the perimeter of the front and back to give a brickface appearance to the wall, and shear notches are defined just behind the front and back, and the units are devoid of surfaces facing toward one side. Special corner units are provided, along with cap units having transverse bores. Retaining walls and fence walls employing the units at integral footings defined by the units and drainage passages defined by cooperating drainage grooves. Piers can be provided to permit the construction of higher walls.

28 Claims, 14 Drawing Sheets

INTERLOCKING BUILDING UNITS AND WALLS CONSTRUCTED THEREBY

CROSS-REFERENCE TO RELATED APPLICATIONS

This is a continuation-in-part of Ser. No. 305,829, filed on Feb. 3, 1989 now abandoned, which is a continuation-in-part of Ser. No. 228,152, filed on Aug. 4, 1988, abandoned.

BACKGROUND OF THE INVENTION

The present invention relates to building blocks and, more particularly, to interfitting construction units and walls constructed of the units without mortar.

Many free-standing and retaining walls are constructed either from poured concrete or from bricks or concrete blocks held together by mortar. In the case of poured concrete, skilled labor is required to construct forms, and pour and finish the concrete to form the wall. Footings must also be provided and, as a result, the intensity of labor necessary to construct a poured concrete wall involves high labor costs. Similarly, in constructing a wall of bricks or concrete blocks, skilled masons are required to apply the mortar and lay the blocks, again involving high labor costs.

Systems are known which employ modular construction units which fit together without mortar to form a wall. Thus, some of the cost involved in the labor-intensive conventional poured concrete, brick or concrete block walls is avoided. However, most of the known mortarless units have shapes which require them to be produced in special machinery or at a low output rate, or both, which results in the cost of the units to be high. In addition, the absence of mortar makes it easier for water to flow into crevices between units and remain there, especially in retaining wall applications. If this occurs in a region where there is freezing, the water freezes and expands, breaking up the units. Even where there is no freezing, the trapped water causes efflorescence; that is, the water seeps into the units, dissolves salts naturally present in the clay or cementitious material of which the units are made, and carries the salts to the surfaces of the units, where the salts cause unsightly stains.

Some of the known mortarless units can be stacked only at an angle, thereby rendering them unsuitable in constructing free-standing walls, and useful only in constructing retaining walls. Some of the units which stack at an angle require backfilling to be performed after each course is laid in a retaining wall. Some of the known mortarless units which can be stacked essentially vertically have only one finished face, that is, only one face having an acceptable appearance. At least one known mortarless system employs separate fiberglass pins which are inserted into holes in the top surfaces of units on the job site in order to provide interfitting between adjacent courses.

Some of the units require separate footings or special wedge-shaped pieces to orient the wall at a desired angle, while other retaining wall systems require the earth under the wall to be shaped to a predetermined angle. Many of the known mortarless units are not adapted to cooperation with piers whereby walls of greater height can be constructed. Due to their mortarless nature, the units of some systems can be easily disassembled by vandals. In some systems, the units are too heavy to be moved and assembled without mechanical equipment.

SUMMARY OF THE INVENTION

By the present invention, a modular concrete unit is provided which interfits with similar units to form free-standing and retaining walls without the use of mortar.

The units according to the present invention can be made in conventional concrete block machines merely by providing a mold having a complementary shape. As a result, the blocks can be produced at high speed and slipped from the mold like conventional concrete blocks, on the order of every six seconds.

The construction units according to the present invention include drainage grooves which cooperate with the drainage grooves in adjacent units to define passages for allowing water to weep from crevices between units. Thus, the problems of unit breakup due to the freezing of trapped water and staining due to efflorescence are avoided. The units can be stacked vertically and the slope of soil to be retained can be approximated by shifting higher courses of the blocks relative to lower courses while maintaining an interfitting relationship. Any needed footing can be formed by the units themselves, and the construction of the wall can be performed by workers having a relatively low level of skill. Both the front and the back faces of the units have an architectural finish, so that either face can be exposed in a retaining wall application, and both faces can be exposed simultaneously in a free-standing wall. In addition, several courses of units can be laid before any backfilling is necessary. The system according to the present invention allows for the interfitting of units with one another around voids to permit the formation of piers, thereby allowing walls of greater heights to be constructed. In addition to being sized and shaped to allow the forming of units in conventional block concrete machines, the units are kept light enough to be lifted and put into place by the average do-it-yourselfer.

In order to obtain the aforementioned advantages, a basic unit according to the present invention, which is sometimes called a "stretcher", includes a plurality of sections of generally rectangular shape offset from adjoining sections to define alternating plateaus and recesses. The plateaus and recesses interfit with the plateaus and recesses of adjacent courses, thereby providing shear resistance greater than that of conventional walls constructed with mortar. Drainage grooves extending along three faces of each unit cooperate with similar grooves on adjacent units to define drainage passages preventing the build-up of moisture in crevices between unit and, moreover, the drainage grooves allow the earth supported in retaining wall applications to drain and dry out, thereby avoiding the buildup of hydrostatic pressure on the retaining wall and the danger of mud slides.

A small beveled edge is defined all around the front and rear surfaces of each unit, the bevels cooperating with the bevels of adjacent units to give the appearance of a wall constructed with mortar, often called a "brick-face" appearance. In order to provide for an alternate appearance, a notch is formed into the top or bottom surface of each unit just behind the front and rear surfaces to permit the units to be sheared by a hydraulic shearer along planes just inside of the front and rear surfaces, thereby defining new front and rear surfaces having a rough, split face or rock face appearance which is sometimes preferred.

DETAILED DESCRIPTION OF THE PREFERRED EMBODIMENTS

Figure 1:
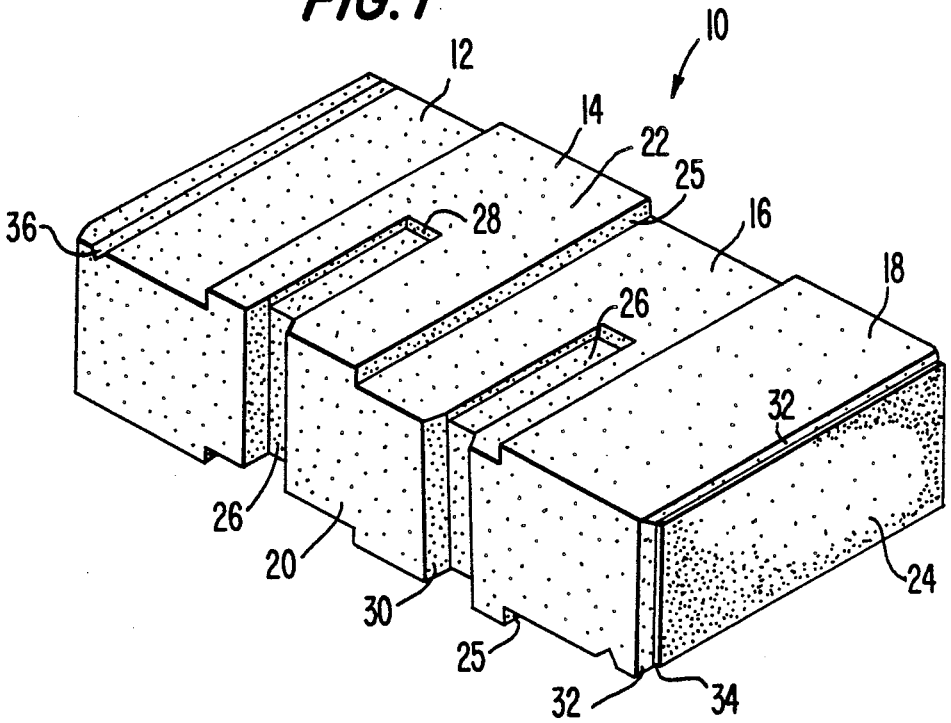
FIG. 1 is an isometric view of a construction unit according to the present invention.

As can be seen from FIGS. 1–4, a basic unit or block according to the present invention, which is sometimes called a "stretcher" and is designated generally by the reference numeral 10, comprises four sections 12, 14, 16 and 18, of which two are end sections 12 and 18 and two are center sections 14 and 16. One side wall 20 of the stretcher 10 is visible in FIG. 1, but the opposite side wall is not. The top of the stretcher is designated by the reference numeral 22, and the front of the stretcher is designated by the reference numeral 24. The portions of each groove 26 extending along the top surface and the bottom face slope down toward the side of the section, so that any water in the portion of the groove 26 which is facing up drains down to the side of the section, rather than accumulate and be absorbed in the material of the stretcher 10. The unit is designed so that the side 20 can define either the left side or the right side of the stretcher 10 in a wall, the surface 22 can be either the top or the bottom of the stretcher in a wall, and the surface 24 can be either the front or rear of the stretcher when it is in a wall. The surface 24 and the opposite surface both have an architectural finish, pleasing to the eye, so that either surface can be the front surface which is exposed to view. Furthermore, since both the front and rear surfaces have an architectural finish, the stretcher is well suited for use in a free-standing wall, where both the front and the rear of the stretcher are exposed to view.

Figure 2:
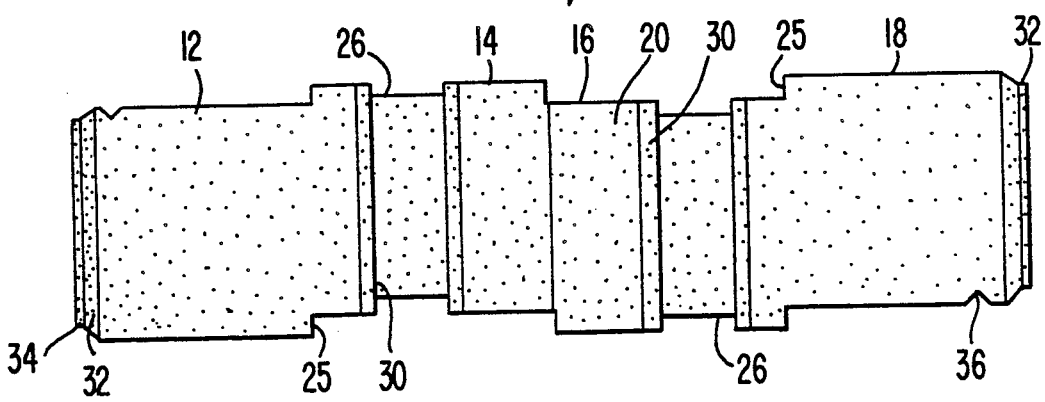
FIG. 2 is a side view of the unit of FIG. 1.
Figure 3:
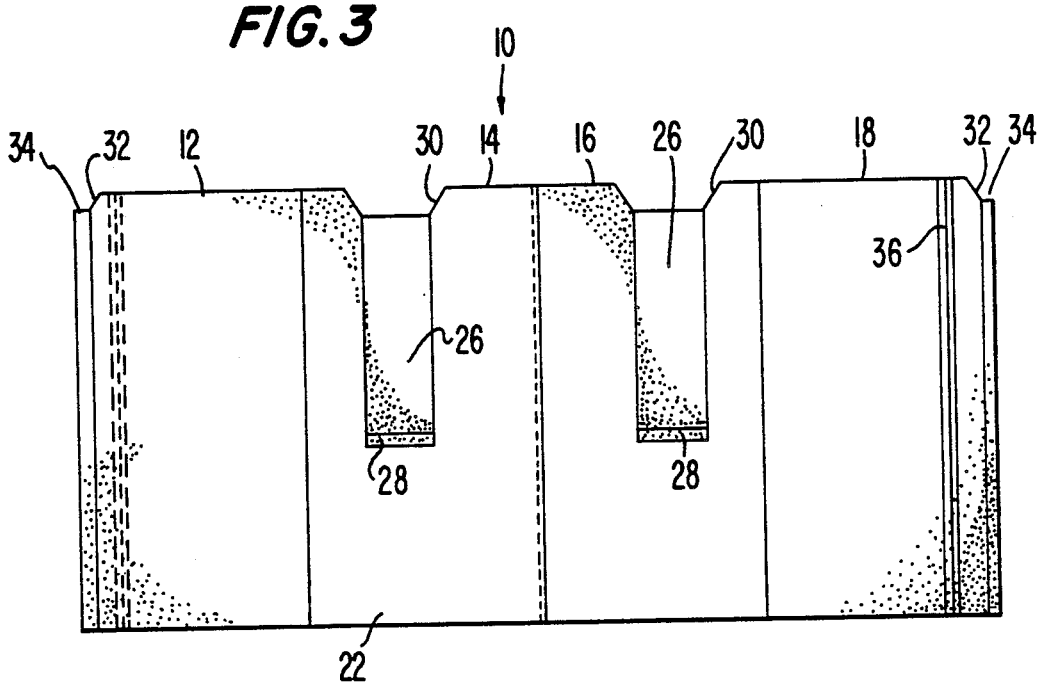
FIG. 3 is a top view of the unit of FIG. 1.
Figure 4:
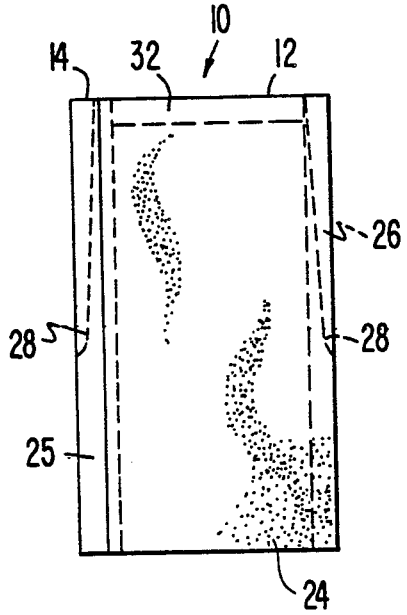
FIG. 4 is a front view of the unit of FIG. 1.
Figure 5:
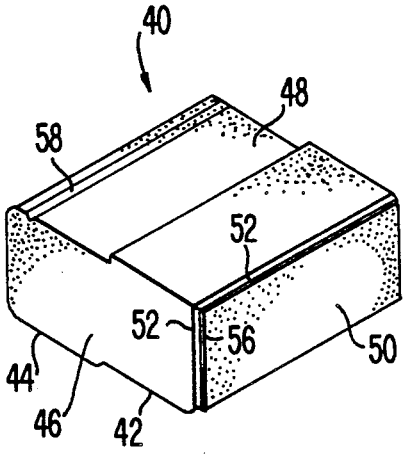
FIG. 5 is an isometric view of a corner unit according to the present invention suited for use with the unit of FIGS. 1–4.
Figure 6:
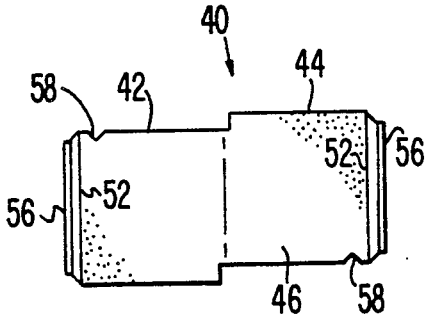
FIG. 6 is a side view of the corner unit of FIG. 5.
Figure 8:
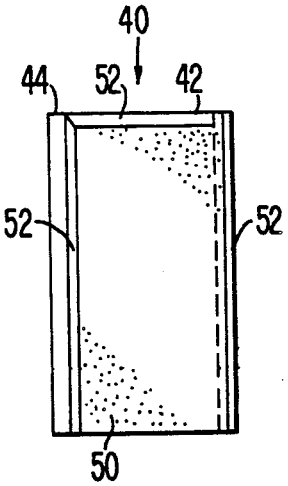
FIG. 8 is a front view of the corner unit of FIG. 5.
Figure 7:
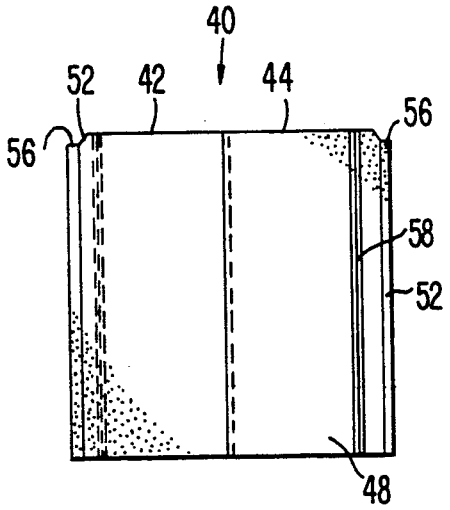
FIG. 7 is a top view of the corner unit of FIG. 5.
Figure 10:
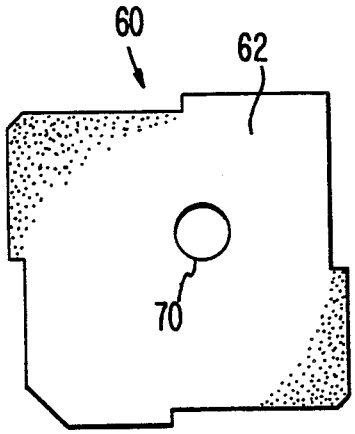
FIG. 10 is a side view of the cap unit according to FIG. 9.
Figure 9:
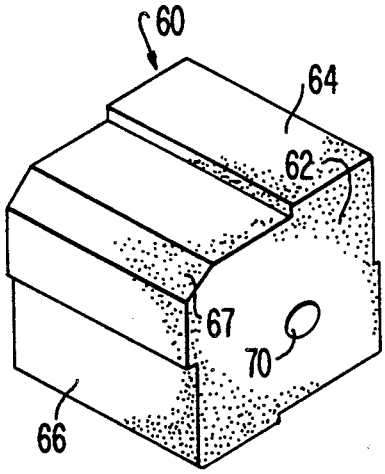
FIG. 9 is an isometric view of a cap unit according to the present invention.
Figure 11:
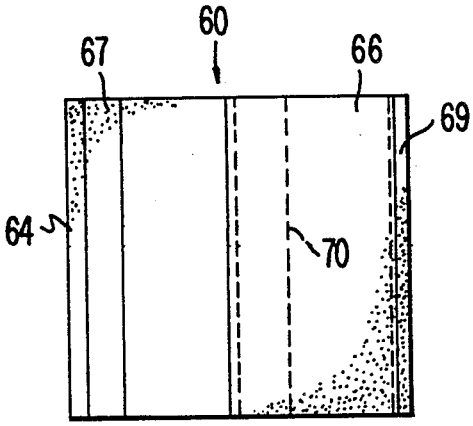
FIG. 11 is a top view of the cap unit of FIG. 9.

The left and right surfaces of each section 12–18 of the stretcher 10, as it is oriented in a wall, lie in common planes, as can best be seen from FIGS. 1 and 3. However, each section is offset slightly from adjacent sections with respect to the top 22 and bottom of the stretcher to define ledges 25 extending at a right angle to the top and bottom of the stretcher, as is best seen from FIGS. 1 and 2. Thus, the top 22 and bottom of the stretcher 10 include alternating plateaus and recesses which provide locking interengagement with the stretchers 10 of the adjacent courses. All of the sections have the same height, whereby a section which defines the plateau on the top 22 of the stretcher 10 defines a recess on the bottom of the stretcher, and a section which defines a recess on the top of the stretcher defines a plateau on the bottom of the stretcher. It can be appreciated that a unit in the same orientation as, for example, the unit as shown in FIG. 2, can be placed upon the unit of FIG. 2 with the result that the plateaus on the bottom of the upper unit will register with and interlock with the recesses on the top of the unit of FIG. 2, and the recesses on the bottom of the upper unit will register with and interlock with the plateaus on the top of the unit of FIG. 2, so that shear forces tending to move one stretcher to the front or rear relative to the other stretcher will be resisted. The same interengagement would be obtained if the upper unit were flipped front over back, or vice versa. It can also be appreciated that the upper unit could be shifted two sections toward the front or back and obtain a similar interfitting or interlocking engagement with the unit of FIG. 2. It is such interfitting engagement which provides a sufficient safety factor to allow walls to be constructed of the units according to the present invention without the use of mortar or shear pins. The dimension of each plateau from the front to the rear of the stretcher 10 is slightly less than the corresponding dimension of each recess, for example, 1/16 inch less. As a result, there is a small gap between the plateaus of mating stretchers 10, and the stretchers can be angled slightly with respect to one another.

A drainage groove 26 is formed in each of the center sections 14 and 16 of the stretcher 10, each groove 26 extending from approximately the center of the top surface of each center section, down one side of the section and across to approximately the center, or slightly beyond, of the bottom face of the section. An angled transition wall 28 connects each end of the grooves 26 to the adjacent surface of the top 22 or bottom of the stretcher 10, and angled walls 30 extend between the portion of each groove extending along the side 20 of the stretcher 10 and the surface of the side 20. The drainage grooves 26 permit water which may enter the crevice between the stretcher 10 and a similar stretcher unit above it to flow to the side of the unit and then down along the side of the unit.

The front 24 and rear of the stretcher 10 are bordered on three sides by a beveled surface 32 which extends out to a narrow perimeter shoulder 34 near the side 20, which is best seen in FIG. 3. This configuration gives a wall constructed with stretchers 10 according to the present invention a "brickface" appearance, which is the look of a wall constructed with mortar. In order that an optional surface treatment may easily be obtained for the wall, a shear notch 36 is formed in either the top 22 or bottom of the stretcher 10, spaced slightly behind the perimeter shoulder 34. The shear notch 36 is adapted to receive a hydraulic shear, a tool commonly used in the trade, by which the original front 24 or rear of the stretcher 10 can be sheared off, leaving a rough, split face or rock face appearance, instead of the previous brickface appearance. The shear notch 36 serves to assure that the stretcher will shear along a predetermined plane, and that the rough sheared faces of each of the stretchers will lie in the same plane.

It can be seen that the stretcher 10, when in the orientation shown in FIGS. 1 and 3, can be slipped downward out of a mold at least for the reason that there are no laterally extending recesses or projections which would be destroyed when the unit is slipped down out of a mold. In the mold, the stretchers 10 are in the orientation of the stretcher shown in FIG. 1, and the portions of the drainage grooves 26 lying in the top 22 and bottom of the stretchers 10 are open at the top when the unit is in the mold, so that they are not affected when the stretcher is slipped down out of the mold. The stretcher 10 is devoid of surfaces facing toward the side opposite the side 20, since the opposite side is at the bottom in the mold and any surfaces facing the bottom would be literally wiped out as the stretcher 10 is slipped down out of the mold. Furthermore, the stretcher 10 can have a dimension from front 24 to rear of 15 and 15/16ths inches (nominally 16 inches), and a dimension from the left side to the right side of 8 inches, so that the stretchers 10 fit modularly into the mold box of a conventional concrete block machine. Furthermore, the stretchers 10 can have a nominal height of 4 inches so that, with appropriate divider plates, an integral number of stretchers can be produced from a conventional mold box for each cycle of the concrete block machine. Each section of the stretcher 10 can be considered a module. Thus, the stretcher 10 includes four modules. It can be appreciated that units containing two such modules could be made in the same mold box and that twice as many of the two module units could be made at one time.

The modular nature of the stretchers 10, in which adjacent modules are offset with respect to one another, allows the modules to be split along a plane at which adjacent modules are connected, such as by hydraulic shearing after the stretchers are cured. Thus, the four module stretcher 10 could be split in half to produce two units each having two sections. Similarly, a six module stretcher could be produced which could be used in construction as a six section stretcher, or could be split in the center at the time of manufacture to produce two like three section stretchers. Alternatively, the six section stretchers could also be split at the time of manufacture to produce one two module unit and one four module unit. The shearing after curing produces a rough, split face or rock face appearance, so that retaining walls constructed using such units can be made with either the rough face or the relatively smooth opposite face exposed. In addition, modules of different sizes can be molded easily, as long as an integral number of them are accommodated by the mold box being used. Although the units according to the present invention will be discussed herein as being made of concrete, and are especially well suited to be molded from concrete, it is understood that the units can be made from other suitable building materials.

As can be seen from FIGS. 5–8, a corner unit 40 is provided for use in constructing walls in connection with the stretcher 10, especially in corners of the walls. The corner unit 40 includes just two modules or sections 42 and 44 offset from one another in the manner of the stretcher 10 and by the same amount as in the stretcher 10, and each section 42, 44 of the corner unit 40 has the same dimensions as one of the sections 12–18 of a stretcher 10. The corner unit 40 has a side 46 and an opposite side (not shown), a top 48 and a bottom (not shown), a front 50 and a rear (not shown), bevel edges 52 extending around three edges of the front 50 and the rear, a shoulder 56 between the side bevel edge 52 and the front 50, a similar shoulder between an opposite side bevel edge and the rear, and a shear notch 58. Thus, the corner units 40 interfit with the stretchers 10 and have top and bottom surfaces which are equal to one-half of the top and bottom surfaces of the stretcher units. The corner units 40 can be produced in a standard concrete block machine.

Figure 12:
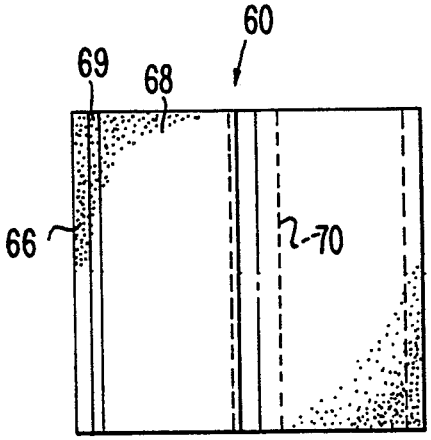
FIG. 12 is front view of the cap unit of FIG. 9.

FIGS. 9–12 illustrate a preferred embodiment of a cap unit 60 according to the present invention. The cap unit 6 has two opposite flat sides, two major sides each defining a plateau and a recess, and two minor sides each defining a plateau and a recess. As shown in the isometric view of FIG. 9, the cap unit 60 is resting on one of its major sides, so that an opposite minor side 64 is facing up. The two minor sides 64 and 66 are adjacent one another and are connected by a large chamfer 67. The two major sides, one of which is indicated by the reference numeral 68 in FIG. 12, are adjacent one another and lie opposite to the minor sides 64 and 66. The areas of the recess of the minor side 64 and the plateau of the minor side 66 are reduced by the presence of the chamfer 67. Otherwise, the plateaus and recesses of the cap units 60 have the same area as the plateaus and recesses of the stretchers 10 and the corner units 40, and are offset by the same amount, so that they interfit with the stretchers and corner units, as well as with each other. Small chamfers 69 are provided along edges of the cap unit 60 between each minor side 64 and 66 and the adjacent major side. The distance from a minor side 64 or 66 of the cap unit 60 to a corresponding point on the opposite major side is twice the height of a stretcher 10 or corner unit 40.

A bore 70 extends through each cap unit 40 from one flat side to the other, so that it can align with similar bores in adjacent cap units to receive longitudinal ties, such as steel reinforcing bars, as will be described hereinafter.

Alternate forms of the construction units according to the present invention are contemplated, and one alternate preferred embodiment is illustrated in FIGS. 13–16. The stretcher unit 80 of this embodiment is like the stretcher 10 illustrated in FIGS. 1–4, except that the stretcher 80 includes five sections 82, 84, 86, 88 and 90, rather than four. The stretcher 80 can have a dimension from front to back of 19 and 15/16ths inches (nominally 20 inches), as well as a nominal height of 3 inches rather than 4 inches. As with the four-section stretcher 10, the five-section or five-module stretcher 80 is dimensioned so that an integral number of the stretchers is accommodated by the mold box. The addition of the fifth section results in two end sections 82 and 90 that are offset from the top or bottom in the same direction; that is, both end sections are either offset toward the top 92 or toward the bottom. In this embodiment, there is a center section 86 which has no drainage groove, drainage grooves 94 being formed instead in intermediate sections 84 and 88 between the center section 86 and the end sections 82 and 90. As with the drainage grooves 26 in the embodiment of FIGS. 1–4, the portions of the drainage grooves 94 contained in the top and bottom surfaces of their sections slope toward the sides of the sections so that any water in the grooves drains toward those sides.

Figure 13:
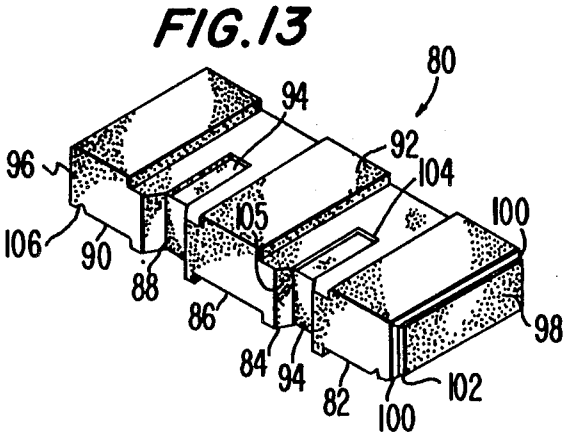
FIG. 13 is an isometric view of an alternate unit according to the present invention.
Figure 14:
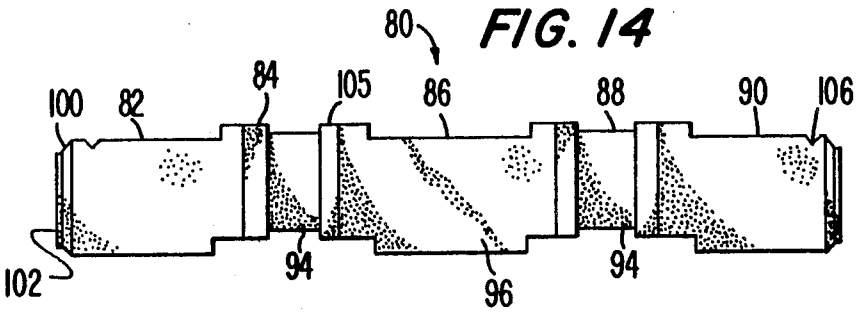
FIG. 14 is a side view of the unit of FIG. 13.
Figure 16:
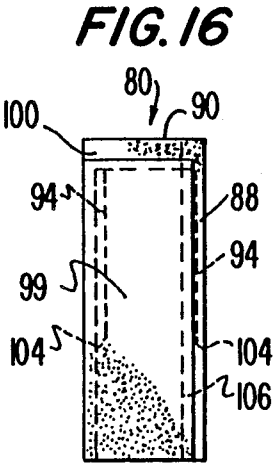
FIG. 16 is a front view of the unit of FIG. 13.
Figure 15:
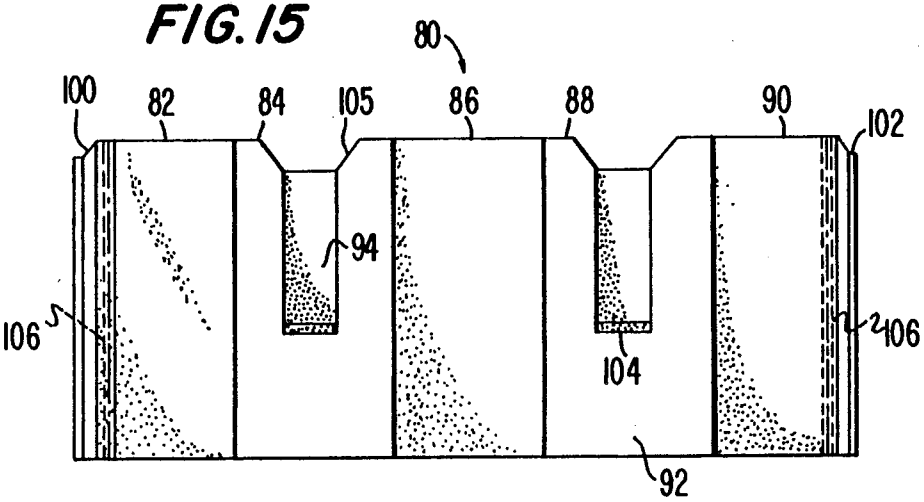
FIG. 15 is a top view of the unit of FIG. 13.
Figure 17:
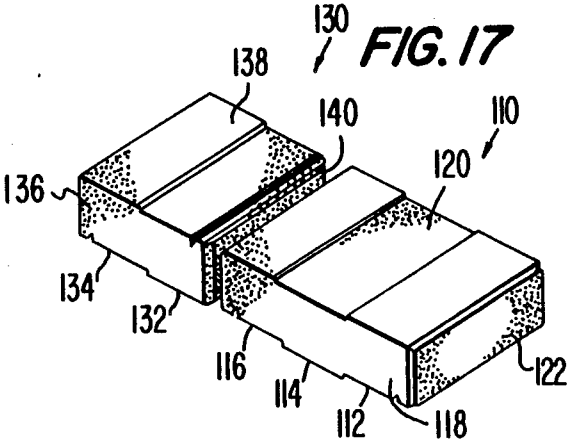
FIG. 17 is an isometric view of corner units according to the present invention adapted for use with the alternate unit of FIGS. 13–16.
Figure 20:
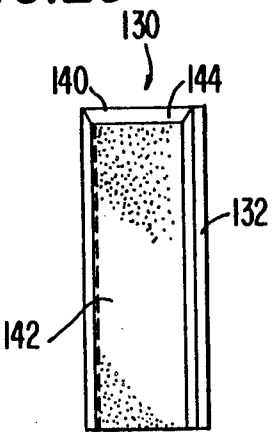
FIG. 20 is a front view of the corner units of FIG. 17.
Figure 18:
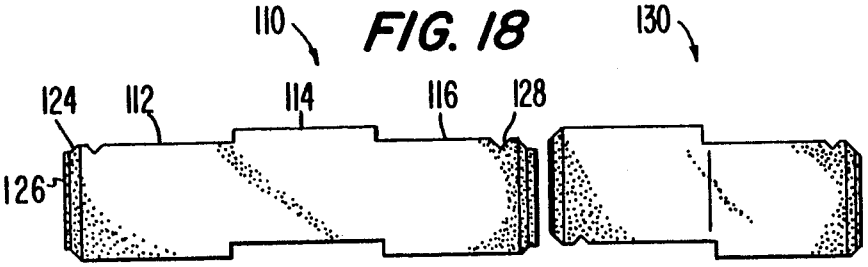
FIG. 18 is a view of the corner units of FIG. 17.
Figure 19:
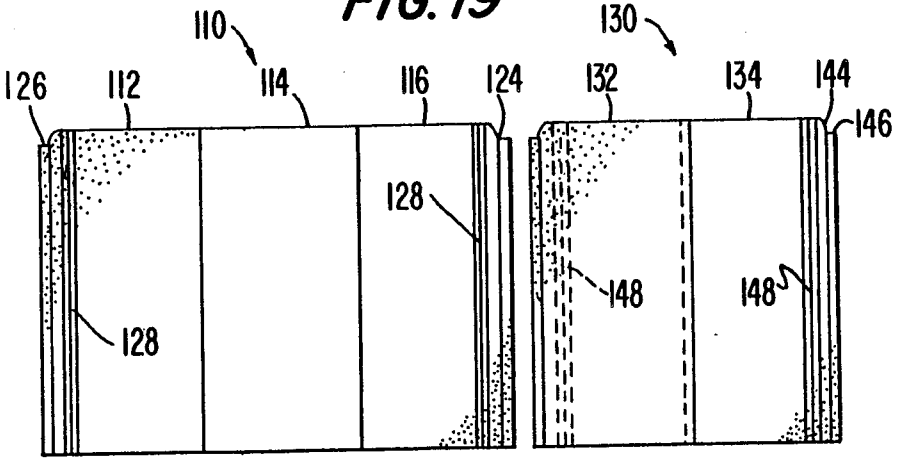
FIG. 19 is a top view of the corner units of FIG. 17.

A side 96 of the stretcher 80 facing left in FIG. 13 can be either the left side or the right side of the stretcher 80 when it is in place in a wall. The sides can be reversed merely by rotating the stretcher 80 around an axis perpendicular to the top 92. A front 98 of the stretcher 80 has bevels 100 extending along three edges of its perimeter, and a shoulder 102 along one of the shorter edges of the front perimeter, between a bevel 100 and the front 98.

An angled transition wall 104 connects each end of the grooves 94 to the adjacent surface of the top 92 or bottom of the stretcher 80. Shear notches 106 are defined in either the top or bottom of each end section 82 and 90 just behind the front 98 or back, so that the brickface originally provided on the stretcher can be sheared off to leave a rough rock face appearance. Angled walls 105 extend between the portion of each groove 94 extending along the side 96 of the stretcher 80 and the surface of the side 96. The height of the five-section stretcher 80 is less than that of the four-section stretcher 10 so that the weight of the five-section stretcher is limited to a manageable amount. As a result, the weight of both types of stretchers 10 and 80, when made of concrete, is about 34 pounds.

As can be seen from FIGS. 17–20, two types of corner units used together are especially well suited for use in connection with the five-section stretcher of FIGS. 13–16. The corner units include a three-section corner unit 110 and a two-section corner unit 130. The corner units 110 and 130 have plateaus and recesses of the same dimensions as the five-section stretcher units 10 and 80, cap units 60 and other corner units 40, and the same amount of offset between plateaus and recesses. In a preferred size for each of the types of units just mentioned, the plateaus have an offset from the recesses of ⅜ths inches, all of the recesses have dimensions of four inches by eight inches, and the plateaus have dimensions of 3 and 15/16 inches by eight inches, so that from an interfitting point of view, the recesses and plateaus of any type of unit interfit with the plateaus and recesses of any other type of unit. In addition, the 1/16 inch difference in the width of the recesses and the width of the plateaus permits the units to be angled slightly relative to one another to form curvilinear walls.

The three-section corner unit 110 includes sections 112, 114 and 116, as well as a side 118 and an opposite side (not shown), a top 120 and a front 122. The three-section corner unit 110 also includes bevels 124, shoulders 126 and shear notches 128, similar to those of the corner unit 40 illustrated in FIGS. 5–8.

The two-section corner unit 130 is essentially the same as the corner unit 40, except that it is shorter than the corner unit 40. The two-section corner unit 130 includes sections 132 and 134, a side 136, and an opposite side (not shown), a top 138, a front 140, a rear 142. It also has bevels 144, shoulders 146, and shear notches 148.

The corner units 110 and 130 together cover one of the five-section stretchers 80, and the provision of two different corner units 110 and 130 to be used in connection with the stretchers 80 provides a great amount of flexibility in constructing walls having corner regions of many configurations.

Figure 21:
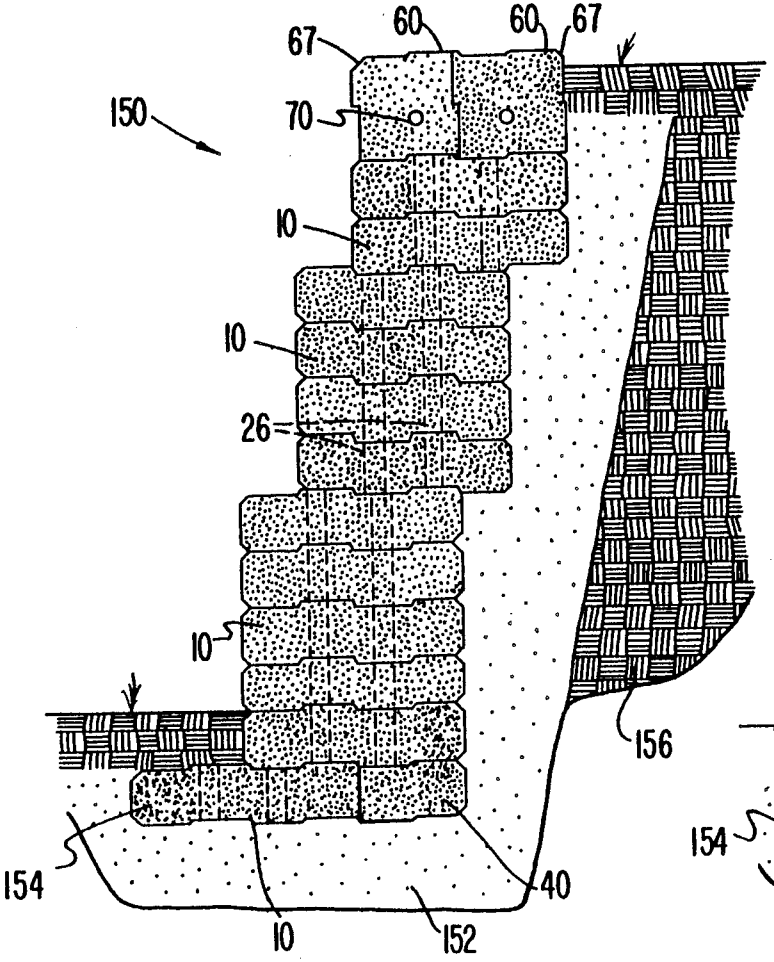
FIG. 21 is a cross section of a retaining wall constructed with units according to the present invention.

The units according to the present invention can be used to construct a retaining wall which is terraced, as can be seen from the retaining wall 150 of FIG. 21. A region of soil where the retaining wall 150 is to be constructed is removed, both behind the wall and under the wall, and compacted granular drainfill is placed in the excavation to a point below the original top soil at the bottom of the retaining wall 50 by a distance equal to the height of two stretchers. Then a course of stretchers, for example, stretchers 10, is laid on the drainfill and a course of corner units 40 is laid with them so that the front of the corner unit 40 engages the back of the stretcher 10 and the surfaces of the stretchers 10 and the corner units 40 considered together comprise alternating plateaus and recesses. Several courses of stretchers 10 are laid over the corner units 40 and the back half of the stretchers 10, so that the front half of the stretchers 10 in the bottom course defines an integral footing 154 for the retaining wall 150. The stretchers 10 in several courses above the footing course are positioned so that the fronts and backs of each unit are flush with the fronts and backs of the units of lower courses and so that the plateaus and recesses of superadjacent and subadjacent courses interfit with one another. The stretchers 10 of each course are staggered with respect to the stretchers 10 of the courses above and below, so as to render all of the stretchers 10 in the retaining wall 150 interfitting with one another. When several courses of stretchers 10 have been laid on the footing course, five courses in the example illustrated in FIG. 21, the excavation is filled in and compacted behind the laid courses, and granular drainfill is poured in and compacted between the courses and the compacted backfill 156.

The next course of stretchers 10 is shifted back toward the soil to be retained relative to the stretchers already laid. The shifted stretchers are shifted by one section of a stretcher 10, which is accomplished by flipping a stretcher over around an axis running from the front to the back of a stretcher. The next several courses are laid directly above the first course of inverted stretchers 10 and staggered laterally, as is customarily done with concrete blocks or bricks. A backfilling and compacting operation is performed behind the inverted courses of stretchers 10, the next course of stretchers is laid right side up, and another right side up course is laid directly above the previous one. This is the last course of stretchers 10 in the retaining wall 150 illustrated in FIG. 21, since it terminates at a level below the level of the soil to be retained by about the height of two stretchers 10, which is equal to the height of one cap unit 60. In the retaining wall 150, a double row of cap units 60 is used to top the retaining wall, the plateaus and recesses of the cap units interfitting with the recesses and plateaus of the top course of stretchers 10 as well as with the plateaus and recesses of the other row of cap units 60 where the two rows of cap units engage along a vertical plane.

In most applications, a retaining wall according to the present invention will retain the load behind it just by the frictional engagement between the adjacent stretchers and will not rely on the interfitting engagement between the plateaus and the recesses. However, if the load overcomes the frictional engagement, the interfitting engagement provides ample resistance to the load. The vertical portions of the drain passages 26 are shown by the dashed lines in FIG. 21. It can be appreciated that the drain passages 26 of adjacent stretchers 10 cooperate with one another to allow water to flow down.

Figure 22:
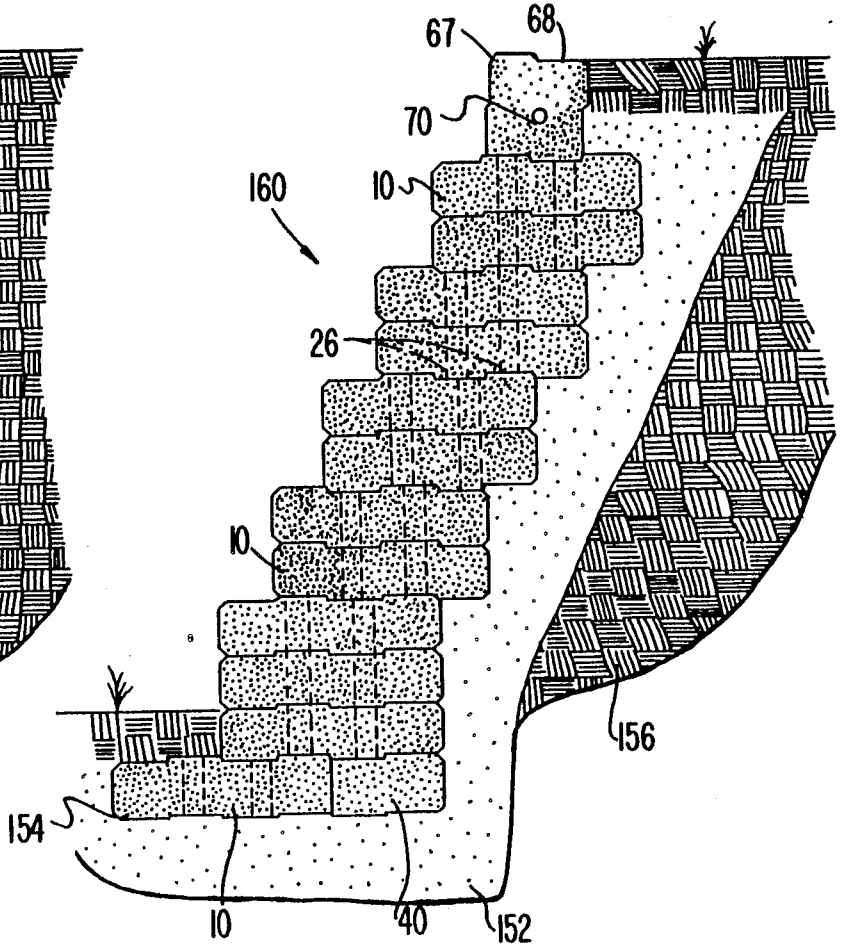
FIG. 22 is an alternate embodiment of retaining wall constructed with units according to the present invention.

Another retaining wall 160 constructed from the units according to the present invention has a pyramid shape, as can be seen from the cross section of FIG. 22. The same type of excavation is formed, the same backfill and drainfill materials can be used, and the same backfilling and compacting operations can be performed as those employed in connection with the terrace arrangement of the wall 150 of FIG. 21. The stretchers 10 and the corner units 40 are again employed to form the integral footing 154, and the first courses of stretchers 10 are laid over the corner units 40 and the back half of the stretcher units 10 of the footing course. Furthermore, additional courses are laid directly above the first course, and still further courses are inverted and laid above the first group of courses so as to be shifted one section farther into the soil to be retained. With the pyramid arrangement of the wall 160, the groups of courses are smaller, and there is a greater number of alternating groups of right side up and inverted courses than with the example illustrated in FIG. 21. The backfilling and compacting operations are performed prior to the laying of each new course which will be shifted back relative to the previous course.

The last course of stretchers 10 is laid about two stretcher heights below the level of the soil to be retained and the cap units are then laid. In the retaining wall 150, a single row of cap units 60 is illustrated, the cap units engaging the two center sections of the stretchers 10. In both of the retaining walls 150 and 160, the bores 70 of laterally adjacent cap units 60 are in alignment with one another so that a tying device, such as a reinforcing bar, can be inserted through the bores 70 and secured at its ends, for example, by grout. In addition, in both walls, the cap units 60 are oriented so that the large chamfers 67 define the top edge of the retaining wall, and, thereby, reduce the likelihood of chipping along that edge. It is understood that additional courses of stretchers could be laid in either retaining wall 150 or 160, the height limitation of the stretchers being determined by soil conditions. Furthermore, the permissible height of retaining walls constructed with units according to the present invention are higher when the walls employ piers or tiebacks as will be described hereinafter.

When the walls are unreinforced, such as by piers, a retaining wall according to the arrangement of FIG. 22 can be made somewhat higher above the ground than the arrangement of FIG. 21, by about 15–20%. Typically, the maximum height of an unreinforced wall of the type shown in FIG. 21 is 4 feet, whereas, for the type shown in FIG. 22, it is 4 feet, 8 inches. A reinforcing wall according to the present invention can be constructed in which each course of stretchers 10 is directly above the next lower course, and the front and rear faces of the wall are planar. An unreinforced retaining wall of this type is limited to a height about 15–20% less than the maximum height of an unreinforced wall in the arrangement of FIG. 21, typically 3 feet, 4 inches.

Figure 23:
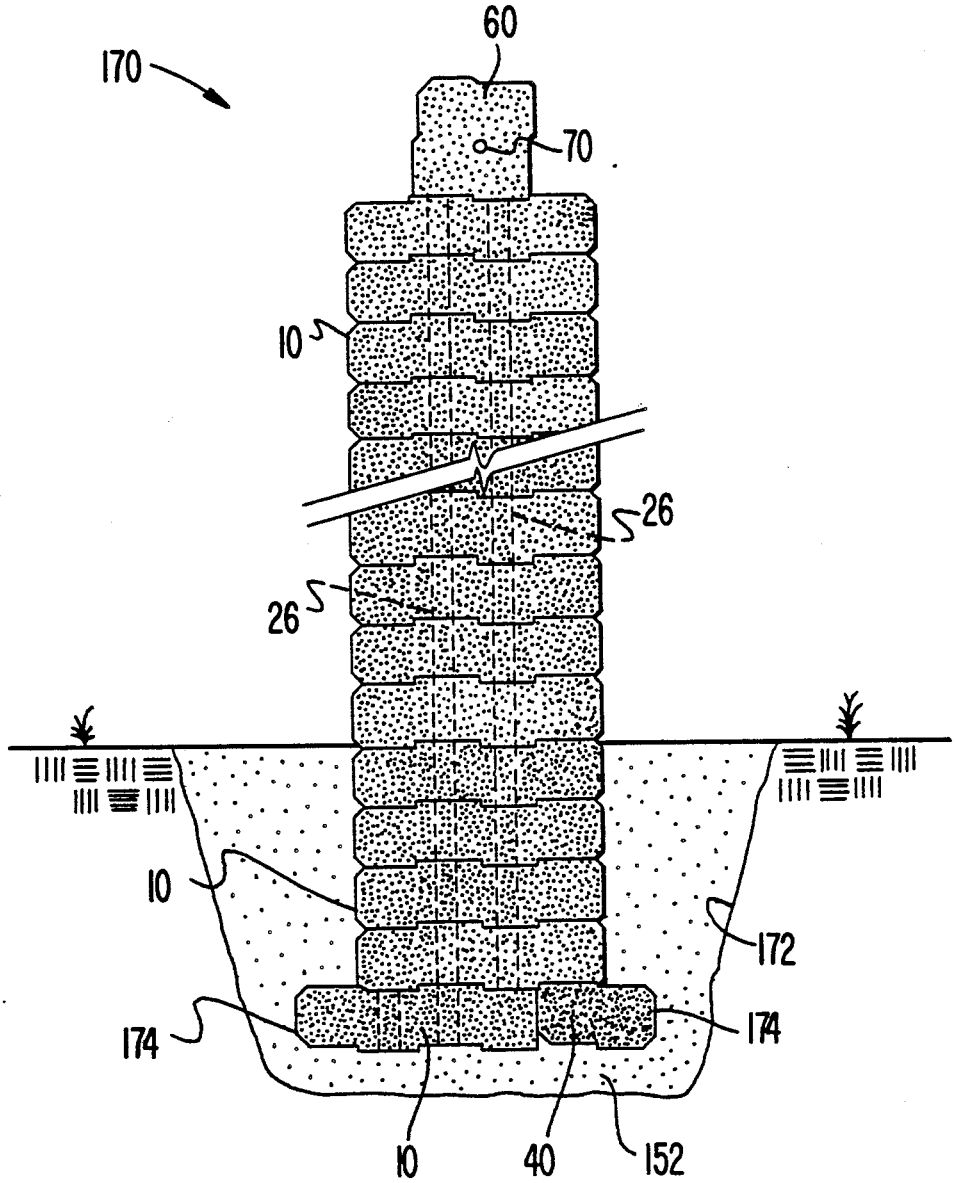
FIG. 23 is free-standing wall constructed with units according to the present invention.

The units according to the present invention are also useful in constructing free-standing walls, such as the wall 170 illustrated in FIG. 23. In preparation for the wall 170, a trench 172 is dug and filled with a few inches of compacted granular drainfill 152, as was done in connection with the retaining walls 150 and 160. Rows of adjacent stretchers 10 and corner units 40 are laid to define an integral footing 174, but the subsequent courses of stretchers 10 are laid so that they cover one-half of the corner units 40 and three of the four sections of the stretchers 10 of the footing course so that an integral footing will be formed which extends beyond both sides of the wall 170 by a distance equal to one section of a unit. All of the courses of stretchers 10 of the free-standing wall 170 are laid directly above the stretchers 10 of the course below, but staggered in a lateral direction. When the courses of stretchers 10 reach the top of the trench 172, the trench is filled and compacted with granular drainfill 152. Further courses of stretchers 10 are laid and are topped off by cap units 60. Although a single row of cap units is used in the embodiment illustrated in FIG. 23, it is understood that a double row of cap units 60 could be employed, similar to the arrangement in the retaining wall 150 of FIG. 21.

Figure 24:
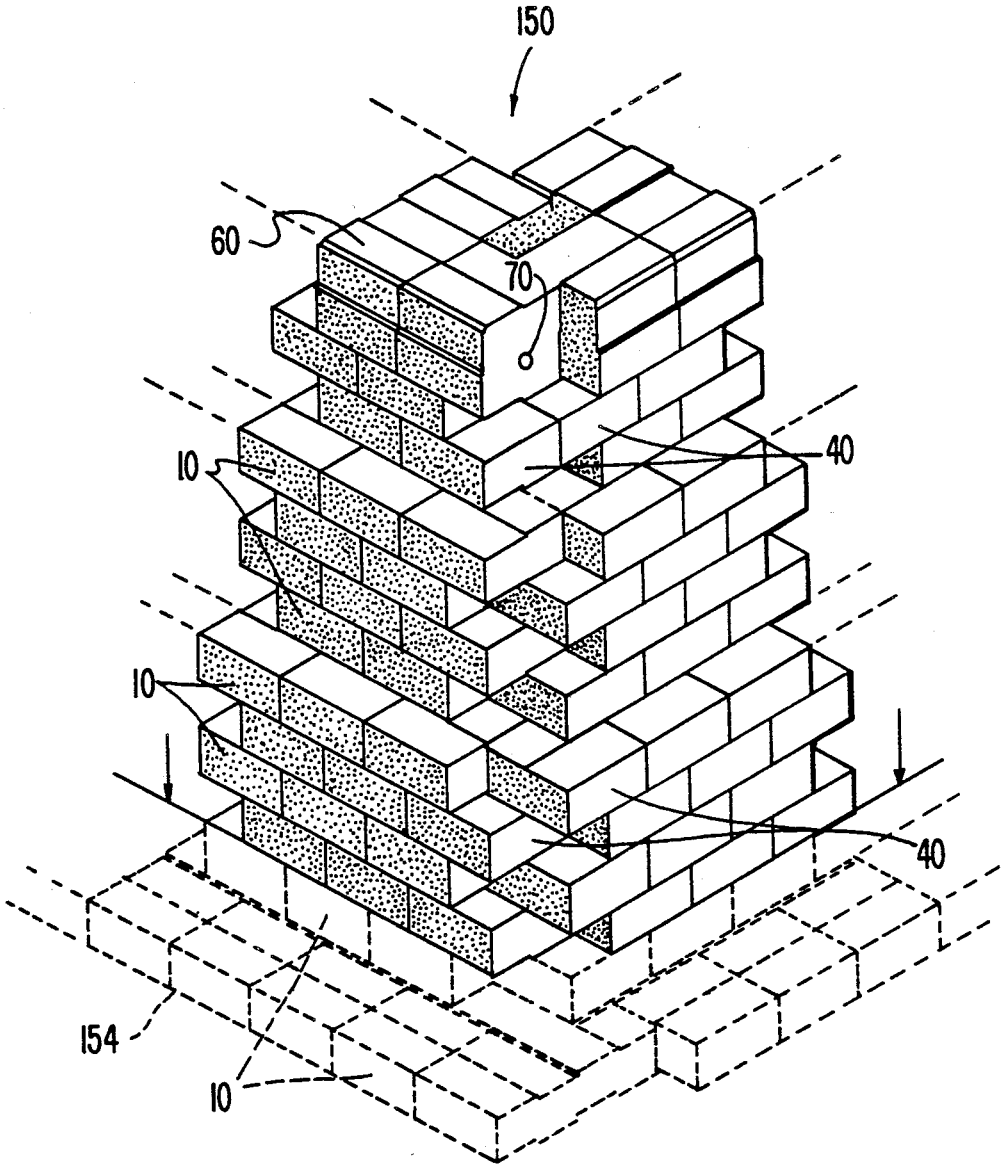
FIG. 24 is an isometric view of a corner of the retaining wall of FIG. 21.

As can be seen from FIG. 24, an interlocking finger arrangement is formed in a corner of a wall according to the present invention and, more particularly, in a corner which can be constructed for the wall of FIG. 21. A foundation for the wall comprising the course of stretchers 10 and cap units defining the integral footing 154 and a superadjacent course of stretchers 10 are shown in dashed lines since they are below the surface of the ground at the base of a wall 150. Four additional courses of stretcher units 10 are laid vertically above the foundation for some stretchers, with each stretcher 10 overlapping the joints between the stretchers in the course below. Two corner units 40 are included at the corner of the wall 150 in each course, the positions of the corner units alternating from course to course to provide the finger lock arrangement. Also included in each course is a void, which may be filled with dirt or other loose material, or may be filled with concrete and reinforced to form a pier 176. Although the presence of piers can avoid the need to step back subsequent courses of stretchers and will most commonly be used in retaining walls where there is no step back, discrete pier sections for each group of courses in vertical alignment also add to the strength of the wall and maintain the stretchers 10 and other construction units according to the present invention in interlocking engagement with one another.

A second group of courses is stepped back from the first group, while the finger lock arrangement and void for a pier are maintained. Although it cannot be seen from the drawing, the void for the pier will also be stepped back relative to the void in the lower group of courses. After a second step back, two more courses of stretchers 10 and corner units 40 are provided before being topped with a double row of cap units 60. After the cap units are laid, it is usually desirable to tie them together in order to prevent vandals from knocking them out of position. This can be done by extending a concrete reinforcing bar through the aligned bores 70 of the cap units and, for example, filling the bores 70 of the end cap units with grout to secure the reinforcing bar in the cap units.

Figure 25:
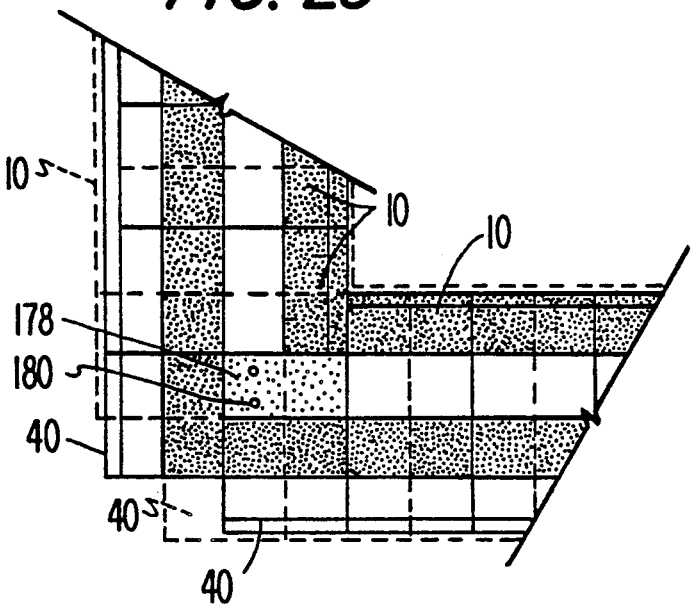
FIG. 25 is a schematic plan view, taken along one course, of a corner of a wall according to the present invention constructed from four-section stretchers.
Figure 26:
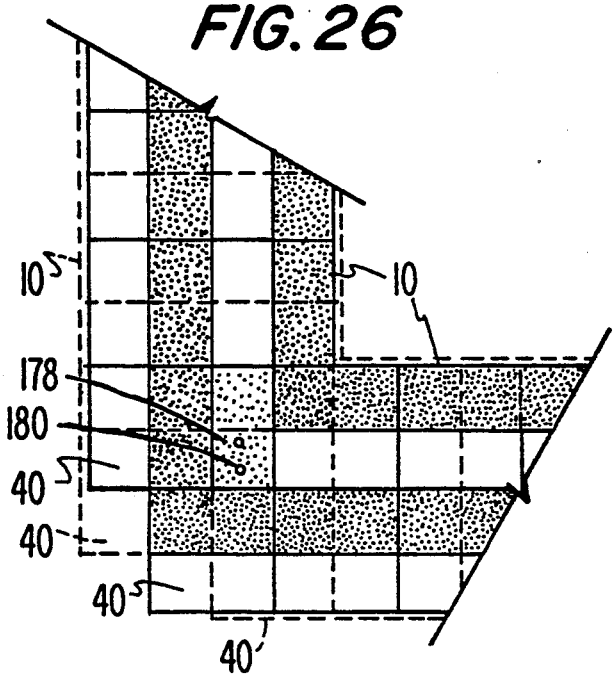
FIG. 26 is a schematic plan view of the corner of FIG. 25, but taken along the next lower course.

In the plan views of FIGS. 25 and 26, in which individual rectangles formed with solid lines define sections of stretchers 10 and corner unit 40, the wall comprises four-section stretchers 10 and two-section corner units 40. The shaded rectangles indicate interlocking engagement between the construction units shown in FIG. 25 and similar units in a course below that shown in FIG. 25. The dashed lines show the positions of the construction units 10 and 40 of the course below that illustrated in solid lines in FIG. 25.

A void left by the arrangement of the construction units 10 and 40 contains a pier 178 which includes reinforcement in the form of vertically oriented reinforcement bars 180. Such reinforcement bars permit walls constructed according to the present invention to be made even higher. The cross section of the pier taken along the course of FIG. 25 has an aspect ratio in which the width (relative to the front of the wall) is greater than the depth, the retaining wall having a cross section equal to the area of one section of a construction unit. As can be seen from FIG. 26, which represents the course of construction units below the course shown in FIG. 25, the aspect ratio of the pier 178 shifts so that the depth is greater than the width, and this shifting takes place with each course, so that in half of the courses, the pier has the aspect ratio shown in FIG. 25, and in the other half, the pier has the aspect ratio shown in FIG. 26. This alternating arrangement of the pier 178 provides greater interlocking between the pier and all the construction units of the wall.

As an alternative to piers, retaining walls according to the present invention can be reinforced through the use of tiebacks. For example, mats of high tensile strength material can be secured to the retaining wall at various heights as the wall is being constructed. Such mats are extended back from the wall and earth is filled in on top of the mats to hold the mats and the wall in place.

Figure 28:
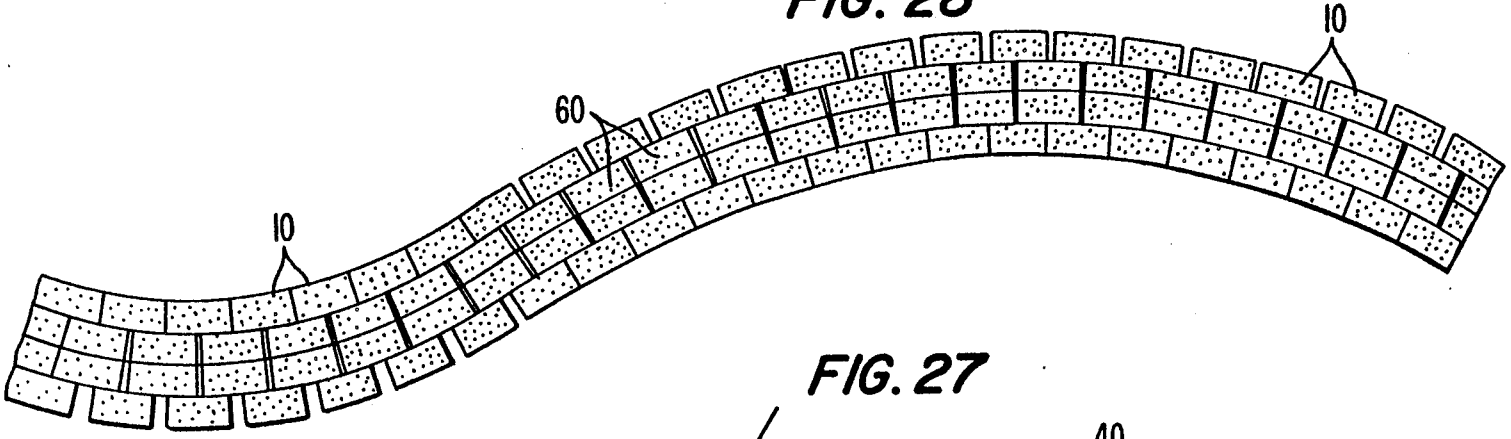
FIG. 28 is a plan view of a curvilinear wall according to the present invention.
Figure 27:
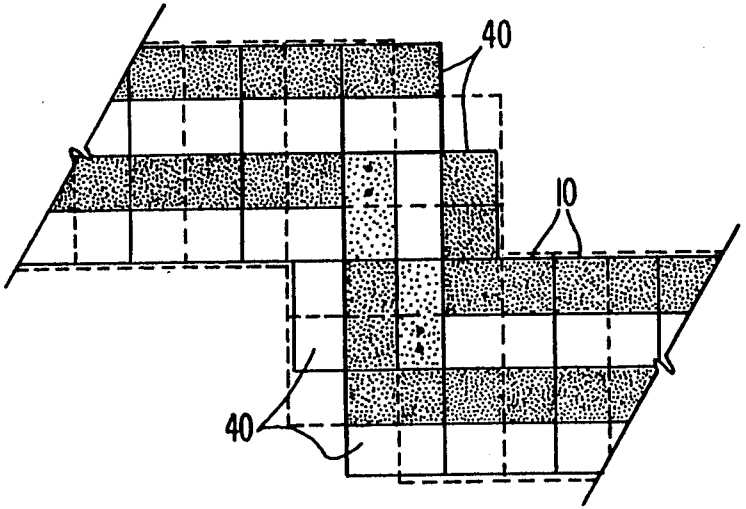
FIG. 27 is a schematic plan view of a pier in a wall according to the present invention.

As can be seen from FIG. 28, a curvilinear wall can be constructed according to the present invention, the wall shown in FIG. 28 employing four-section stretchers 10 and cap units 60. Only the top course of stretchers 10 is illustrated in FIG. 28. The curvilinear shape is made possible by the slight difference between the front-to-rear dimension of the plateaus defined by the stretchers 10 compared with the corresponding dimension of the recesses of the stretchers. The angling of a succession of such stretchers can produce a curvilinear shape having a radius of curvature as small as, for example, five feet. The plateaus and recesses have sharp edges (see FIG. 2) which tend to be chipped off when the stretchers 10 are put into position, and the chips fall into the spaces between the plateaus of mating stretchers 10, tightening up the fit and holding the stretchers at their angled relationship with one another. A more positive tightening of the fit can be accomplished by blowing sand into the gap between the plateaus of the mating stretchers. The sand can also be used in a straight wall to achieve a slight positive slope by placing each stretcher 10 so that its depending plateaus engage the ledges 25 of the mating plateaus of the lower course, and then filling the resultant gap in front of each plateau with sand. A positive slope can also be achieved, without shifting-back any courses and without maintaining plateaus at the back of recesses, by sloping the bottom course of the wall toward the earth or other material to be retained.

The cap units 60 correspond dimensionally with the stretchers 10, so that the dimension front to back of the plateaus defined by the major sides 68 is slightly smaller than the corresponding dimension of the recesses defined by the major sides and similarly smaller than the recesses defined by the other types of units according to the present invention. Thus, all of the units according to the present invention fit together with the slight spacing just described. Therefore, curvilinear walls can also be constructed from five-section stretcher units 80 and from other units according to the present invention.

Figure 29:
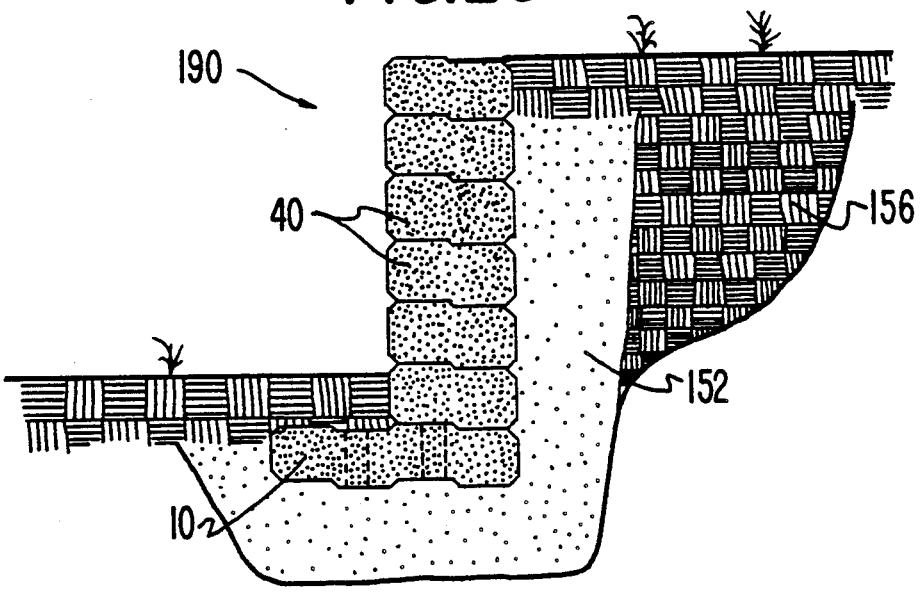
FIG. 29 is a cross section of a retaining wall constructed with corner units according to the present invention.
Figure 30:
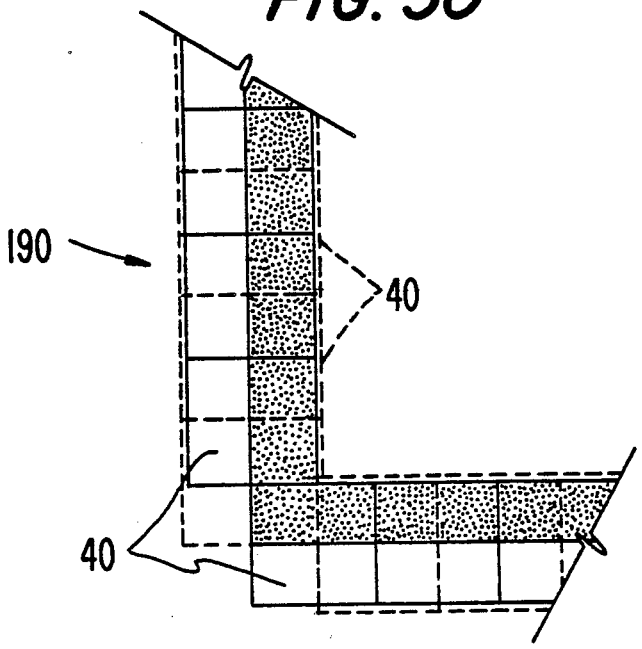
FIG. 30 is a schematic plan view, taken along one course, of a corner of a wall according to the present invention constructed from corner units.

As can be seen from FIGS. 29 and 30, a retaining wall 190 can be constructed according to the present invention employing only corner units 40 arranged on a footing course of stretchers 10. In this construction, it is important that the plateau of the front section of each corner unit 40 be oriented upward in order to provide a ledge preventing successive courses of corner units 40 from sliding forward. The retaining wall 190 can terminate in a top course of corner units 40, as shown in FIG. 30, or can include a top course of cap units 60, in which case the cap units can be laid in positions corresponding to the positions of the corner units 40.

Figure 31:
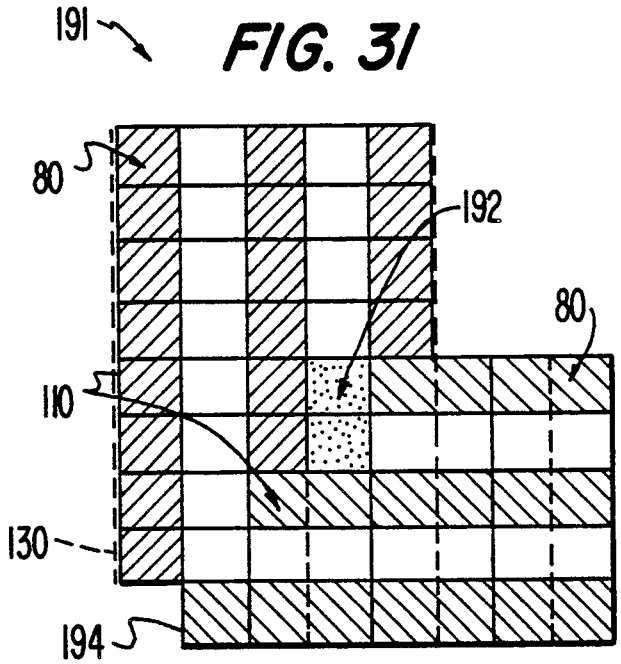
FIG. 31 is a schematic plan view, taken along one course of a corner of a wall according to the present invention constructed from five-section stretchers.

A corner of a wall 191 constructed using the five-section construction units 80 shown in FIGS. 13–16, along with the corner units 110 and 130 shown in FIGS. 17–20, is illustrated in FIG. 31. As in FIGS. 25 and 26, individual rectangles defined by solid lines represent sections of the construction units 80, dashed lines indicate construction units of the course below that shown in FIG. 31, and shaded area represent areas of interengagement between the course of FIG. 31 and the course below. Two three-section corner units 110 are used in the corner, along with one two-section corner unit 130. A pier 192 is provided which has the same alternating aspect ratio feature as the pier 180 of FIGS. 25 and 26. A portion of a corner unit from the course below is visible, as indicated by the reference numeral 194, and is a part of the finger lock arrangement like that of FIG. 24.

Figure 32:
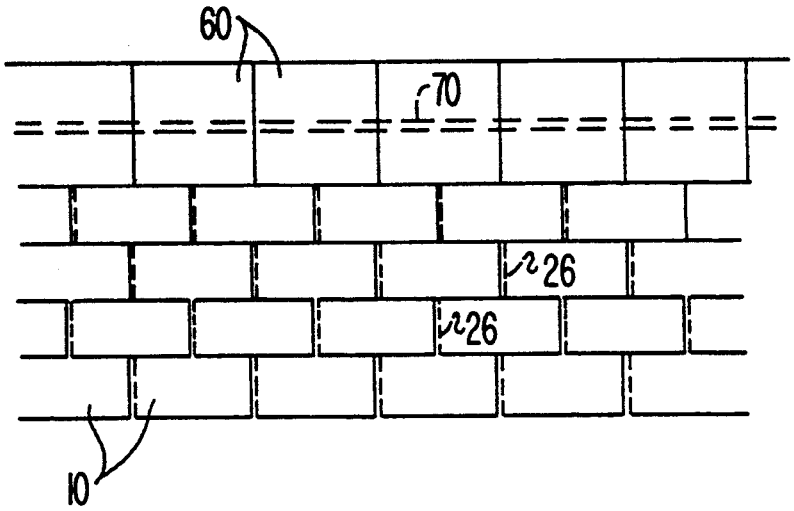
FIG. 32 is a schematic front view of a wall according to the present invention showing a drainage pattern.

The drainage grooves 26 of the individual stretchers 10 cooperate to define drainage passages extending throughout a wall constructed according to the present invention, as can be seen from the schematic view of FIG. 32. Portions of the individual drainage grooves 26 are indicated by the dashed lines in FIG. 32. Although not illustrated in that figure, each drainage groove 26 includes a portion extending from the vertical portion of the groove to approximately the center of the bottom of the stretcher containing the groove. Each groove 26 has a portion extending down the side of its stretcher 10 to the bottom of the stretcher where it feeds draining water to a drainage groove 26 at the center of the top of the stretcher 10 in the course below. Although only one drainage pattern has been illustrated, it is understood that other drainage patterns occur with changes in orientation of stretchers 10. For example, when a stretcher 10 is reversed with respect to the stretchers in the course below, such as in the step backs of FIGS. 21 and 22, the drainage pattern will continue in a pattern which extends down and to the right.

Figure 33:
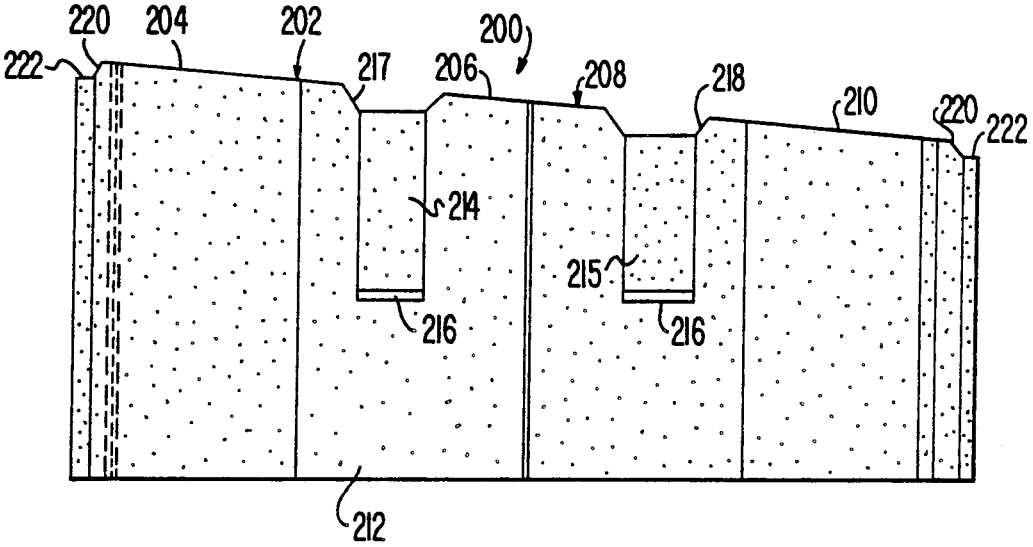
FIG. 33 is a top view of a construction unit according to the present invention having angled side.

Curvilinear walls, such as the curvilinear wall illustrated in FIG. 28, which are made from the four-section stretchers 10 illustrated in FIGS. 1–4, have open joints due to the curved nature of the wall and the rectangular nature of the stretchers 10. Since open joints are sometimes undesirable, the present invention also contemplates a stretcher having one side lying at an angle with respect to the opposite side. As can be seen in FIG. 33, the tapered stretcher 200 has an angled side 202 extending through four sections 204, 206, 208 and 210. The stretcher 200 has a top surface 212 in which drainage grooves 214 and 215 are defined, the drainage grooves having angled transition walls 216 and angled walls 217 and 218 extending between the angled side 202 of the stretcher 200 and portions of the grooves 214 and 215 which pass along the angled side 202. As with the drainage grooves 26 of the stretchers 10, the drainage grooves 214 and 215 slope toward the side so that water runs off. The front and rear of the stretcher 200 are bordered on three sides by a beveled surface 220 which extends out to a narrow perimeter shoulder 222 near the angled side 202.

Figure 34:
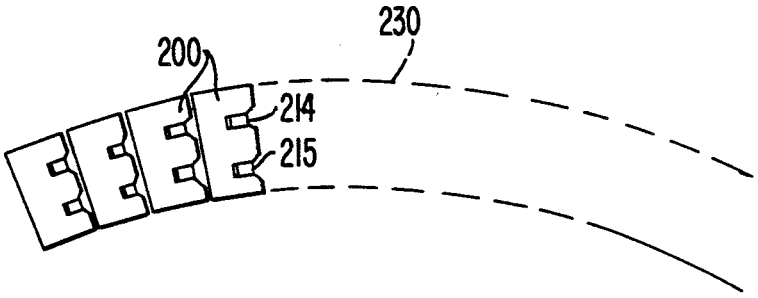
FIG. 34 is a schematic plan view of a curvilinear wall employing a plurality of the units of FIG. 33.

As can be seen from FIG. 34, a plurality of the stretchers 200 having an angled side can be placed next to one another to approximate an arc so as to define a curvilinear wall designated generally by reference numeral 230, while maintaining closed joints. It is understood that additional courses of the stretchers 230 are used above and below the course shown, with the stretchers of each course overlying the joints between the stretchers in the course below.

The corner units 40 and the cap units 60 can be used with the angled stretchers 200. The molds for making the angled stretchers 200 can easily be adjusted to change the angle of the side 204 so that curvilinear walls having different radiuses of curvature can be constructed with closed joints.

Although certain preferred embodiments of the interfitting modular construction units and walls according to the present invention have been described herein, it will be appreciated by those skilled in the art and it is contemplated that variations and/or changes in the embodiments illustrated and described herein may be made without departing from the present invention. Accordingly, it is intended that the foregoing description is illustrative only, not limiting, and that the true spirit and scope of the present invention be determined by the appended claims.

I claim:

1. An interfitting modular construction unit comprising:

a block having a top, a bottom parallel to the top, a front, a rear and two sides, said block including a plurality of sections each generally defining a parallelepiped, each said section having a top, a bottom, two sides defined by the sides of the block, a width between said two sides of said section, a height between said top and said bottom of said section, and a depth transverse to said height and said width of said section, the height and depth of each section being substantially the same as the height and depth of each other section, each said section extending from one of said two sides of said block to the other of said two sides, each said section being offset from adjacent sections in a direction transverse to the top and the bottom of the block to define at least one plateau and at least one recess in the block and ledges perpendicular to the top and bottom of the block, the plateau of said block being sized to fit into the recess of said block, whereby a plurality of said blocks can interfit with one another, said block further having a drainage groove defined in at least one of said sections, said drainage groove extending from said top of said block midway between said two sides of said block, along one of said sides of said block, and across said bottom of said block to midway between said two sides of said block.

2. The construction unit of claim 1, further comprising bevels between said front of said block and each of said top, said bottom and one of said sides of said block, and between said rear of said block and each of said top, said bottom and one of said sides of said block.

3. The construction unit of claim 1, wherein said plateaus are smaller than said recesses, whereby said block can interfit with a like block at an angle with respect to the like block.

4. The construction unit of claim 1, wherein one of said sides of said block likes at an oblique angle with respect to the other of said sides of said block.

5. The construction unit of claim 1, wherein said block is devoid of surfaces which lie off of one of said sides of said block and face toward said one side, whereby said block can be formed in and slipped out of a mold.

6. An interfitting modular construction unit comprising:

a block having a top, a bottom parallel to the top, a front, a rear and two sides, said block including a plurality of sections each generally defining a parallelepiped, each said section having a top, a bottom, two sides, a width between said two sides of said section, a height between said top and said bottom of said section, and a depth transverse to said height and said width of said section, the height and depth of each section being substantially the same as the height and depth of each other section, each said section extending from one of said two sides of said block to the other of said two sides, each said section being offset from adjacent sections in a direction transverse to the top and the bottom of the block to define at least one plateau and at least one recess in the block and ledges perpendicular to the top and bottom of the block, the plateau of said block being sized to fit into the recess of said block, whereby a plurality of said blocks can interfit with one another.

further comprising a notch extending across one of said top and said bottom of said block adjacent to said front of said block, whereby said front of said block can be sheared off along a predetermined plane.

7. The construction unit of claim 6, further comprising a notch extending across one of said top and said bottom of said block adjacent to said rear of said block, whereby said rear can be sheared off along a predetermined plane.

8. An interfitting modular construction unit comprising:

a block having two opposite flat sides parallel to one another, and four other sides extending between said two flat sides, each of said other sides defining a plateau and a recess, each plateau and each recess extending across the block from one flat side to the other flat side, each plateau and each recess defining a surface lying generally opposite, respectively, a recess and a plateau on an opposite side of the block, the surface defined by each plateau and each recess being parallel to the surface defined by, respectively, the opposite recess and the opposite plateau, and a bore extending through the block from one flat side to the other flat side.

9. The construction unit of claim 8, further comprising a chamfer extending from one flat side to the other flat side between two of said other sides.

10. A wall comprising a plurality of interfitting construction units arranged in courses, wherein each unit includes a top, a bottom parallel to the top, a front, a rear and two sides, each side block further including a plurality of sections each having a top, a bottom, two sides and a height between said top and said bottom of said section, the height of each section being substantially the same as the height of each other section, each said section extending from one of said two sides of said block to the other of said two sides of said block, each said section being offset from adjacent sections in a direction transverse to the top and the bottom of said block to define at least one plateau and at least one recess, the plateau of each said unit interfitting with a recess of a unit of an adjacent course, wherein drainage grooves are defined in said construction units, the construction units of each course are staggered laterally with respect tot he construction units of adjacent courses, and said drainage grooves define drainage passages extending from midway between the sides of construction units in a top course, down along sides of said unit to areas midway between the sides of units of the subjacent course, and down along sides of said units of said subjacent course to lower courses in a repeating pattern.

11. The wall of claim 10 further comprising a footing course defined by adjacent rows of said construction units, a portion of the units of at least one of said rows extending beyond the front or the rear of the construction units of the superadjacent course.

12. The wall of claim 11, wherein a portion of the units of one of said rows of construction units in the footing course extends beyond the front of the construction units of the superadjacent course, and a portion of the units of a second row of construction units in the footing course extends beyond the rear of the construction units of the superadjacent course.

13. The wall of claim 10, wherein the fronts of the construction units in a plurality of adjacent courses lie in the same plane.

14. The wall of claim 10, wherein at least one course of the construction units is shifted toward the front or rear relative to an adjacent course by a distance equal to the dimension from front to rear of two sections- of one of said construction units.

15. The wall of claim 10, wherein at least one course of the construction units is shifted toward the front or rear relative to an adjacent course by a distance equal to the dimension from front to rear of one section of a construction unit, the construction units of said shifted course being inverted relative to the units of said adjacent course.

16. The wall of claim 11, wherein said drainage groove defined in one construction unit defines a drainage passage with at least one adjacent unit.

17. The wall of claim 16 wherein each said drainage groove extends from the top of a construction unit midway between the two sides of the unit, along one of said sides of the unit, and across the bottom of the construction unit to midway between said two sides.

18. The wall of claim 10, further comprising a top course of cap units, and means for tying together the cap units.

19. The wall of claim 10, further comprising integral piers extending vertically through said wall.

20. The wall of claim 19, wherein reinforcing elements extend vertically through said piers.

21. The wall of claim 10, wherein the plateau is smaller than the recess, the plateaus of the units of each course lie at an angle in the recesses of the units of adjacent courses, and the wall defines a curvilinear shape.

22. The wall of claim 10, wherein each of said units in at least a portion of said wall has one side lying at an angle with respect to the other side of its unit, and the angled side of each unit lies parallel to and adjacent to the said other side of adjacent units to define a curvilinear wall having closed joints.

23. A wall comprising a plurality of interfitting construction units arranged in courses, wherein each unit includes a top, a bottom parallel to the top, a front, a rear and two sides, each said block further including a plurality of sections each having a top, a bottom, two sides and a height between said top and said bottom of said section, the height of each section being substantially the same as the height of each other section, each said section extending from on e of said two sides of said block to the other of said two sides of said block, each said section being offset from adjacent sections in a direction transverse to the top and the bottom of said block to define at least one plateau and at least one recess, the plateau of each said unit interfitting with a recess of a unit of an adjacent course, the wall further comprising a top course of cap units and means for tying together the cap units, wherein the tying means comprises a bore extending laterally through each cap unit, the bores of the cap units being in alignment with one another, and a tying element extending through said bores.

24. A wall comprising a plurality of interfitting construction units arranged in courses, wherein each unit includes a top, a bottom parallel to the top, a front, a rear and two sides, each said block further including a plurality of sections each having a top, a bottom, two sides and a height between said top and said bottom of said section, the height of each section being substantially the same as the height of each other section, each said section extending from one of said two sides of said block to the other of said two sides of said block, each said section being offset from adjacent sections in a direction transverse to the top and the bottom of said block to define at least one plateau and at least one recess, the plateau of each said unit interfitting with a recess of a unit of an adjacent course, the wall further comprising a top course of cap units, wherein each cap unit includes two opposite flat sides and four other sides extending between said two flat sides, each of said other sides defining a plateau and a recess, one of said other sides facing a subjacent course of said construction units, each plateau and recess of said one other side interfitting with a recess and plateau of said subjacent course.

25. The wall of claim 24, wherein each cap unit includes a chamfer, said chamfers defining a top edge of said wall.

26. The wall of claim 24, wherein the top course includes a plurality of rows of cap units, wherein a second one of said other sides of each cap unit faces an adjacent row of cap units, and a plateau and recess of said second one of said other sides interfits with a recess and plateau of the adjacent row of cap units.

27. A wall comprising a plurality of interfitting construction units arranged in courses, wherein each unit includes a top, a bottom parallel to the top, a front, a rear and two sides, each said block further including a plurality of sections each having a top, a bottom, two sides and a height between said top and said bottom of said section, the height of each section being substantially the same as the height of each other section, each said section extending from one of said two sides of said block to the other of said two sides of said block, each said section being offset from adjacent sections in a direction transverse to the top and the bottom of said block to define at least one plateau and at least one recess, the plateau of each said unit interfitting with a recess of a unit of an adjacent course, and integral piers extending vertically through said wall, each pier being surrounded by said construction units, each pier having an area in horizontal cross section equal to the horizontal area of an integral number of sections of the construction units, whereby the piers interfit with the construction units.

28. The wall of claim 27, wherein the horizontal cross section of the piers taken at every other course has a greater width than depth, and the horizontal cross section of the piers taken at alternate courses has a greater depth than width.

* * * * *